US006776101B1

(12) United States Patent
Pickard

(10) Patent No.: US 6,776,101 B1
(45) Date of Patent: Aug. 17, 2004

(54) FRAGMENTING BULLET

(76) Inventor: Richard K. Pickard, 20505 E. Country Club Dr., Suite 35, Aventura, FL (US) 33180

( * ) Notice: Subject to any disclaimer, the term of this patent is extended or adjusted under 35 U.S.C. 154(b) by 0 days.

(21) Appl. No.: 10/394,553

(22) Filed: Mar. 21, 2003

(51) Int. Cl.[7] ..... F42B 12/24
(52) U.S. Cl. ..... 102/509; 102/507
(58) Field of Search ..... 102/506–510

(56) References Cited

U.S. PATENT DOCUMENTS

| | | | | | |
|---|---|---|---|---|---|
| 90,732 | A | | 6/1869 | Curtis | |
| 122,620 | A | | 1/1872 | Maduell | |
| 219,840 | A | | 9/1879 | Winchester | |
| 948,148 | A | | 2/1910 | Schenk | |
| 1,447,478 | A | * | 3/1923 | Koshollek et al. | 102/508 |
| 1,556,160 | A | * | 10/1925 | Riggs | 102/510 |
| 3,097,603 | A | | 7/1963 | Harper | |
| 3,138,102 | A | | 6/1964 | Mayer et al. | |
| 3,142,256 | A | * | 7/1964 | Mack | 102/508 |
| 3,665,861 | A | | 5/1972 | Jaslow | |
| 4,044,685 | A | * | 8/1977 | Avcin | 102/508 |
| 4,550,662 | A | * | 11/1985 | Burczynski | 102/509 |
| 4,665,140 | A | * | 5/1987 | Pennington et al. | 102/508 |
| 4,665,827 | A | * | 5/1987 | Ellis, II | 102/510 |
| 4,777,883 | A | * | 10/1988 | Chevich | 102/509 |
| 4,836,110 | A | | 6/1989 | Burczynski | |
| 4,882,822 | A | | 11/1989 | Burczynski | |
| 4,947,755 | A | | 8/1990 | Burczynski | |
| 5,187,325 | A | * | 2/1993 | Garvison | 102/509 |
| 5,528,989 | A | | 6/1996 | Briese | |
| 5,801,324 | A | | 9/1998 | Pickard | |
| 5,861,573 | A | | 1/1999 | Pickard | |
| 6,536,352 | B1 | * | 3/2003 | Nadkarni et al. | 102/506 |

FOREIGN PATENT DOCUMENTS

| | | | | |
|---|---|---|---|---|
| DE | 320210 | * | 8/1932 | 102/506 |
| DE | 3822775 | * | 2/1990 | 102/507 |
| GB | 0014717 | * | of 1900 | 102/507 |
| GB | 0001850 | * | 1/1997 | 102/507 |

* cited by examiner

*Primary Examiner*—Harvey E. Behrend
(74) *Attorney, Agent, or Firm*—Ramon L. Pizarro; Edwin H. Crabtree

(57) ABSTRACT

A bullet that has a controlled fragmentation on impact with a target. The bullet includes a generally cylindrical body having a nose, a mid-portion and a heel. The body includes an aperture that starts at the nose, extends past the mid-portion of the bullet and ends near the heel of the bullet. The aperture also includes ay least one scored area along the sides of the aperture and extending along at least some or all of the aperture. The heel portion includes a scored area that terminates at a location that aligns with the scored area along the sides of the aperture in the bullet.

11 Claims, 4 Drawing Sheets

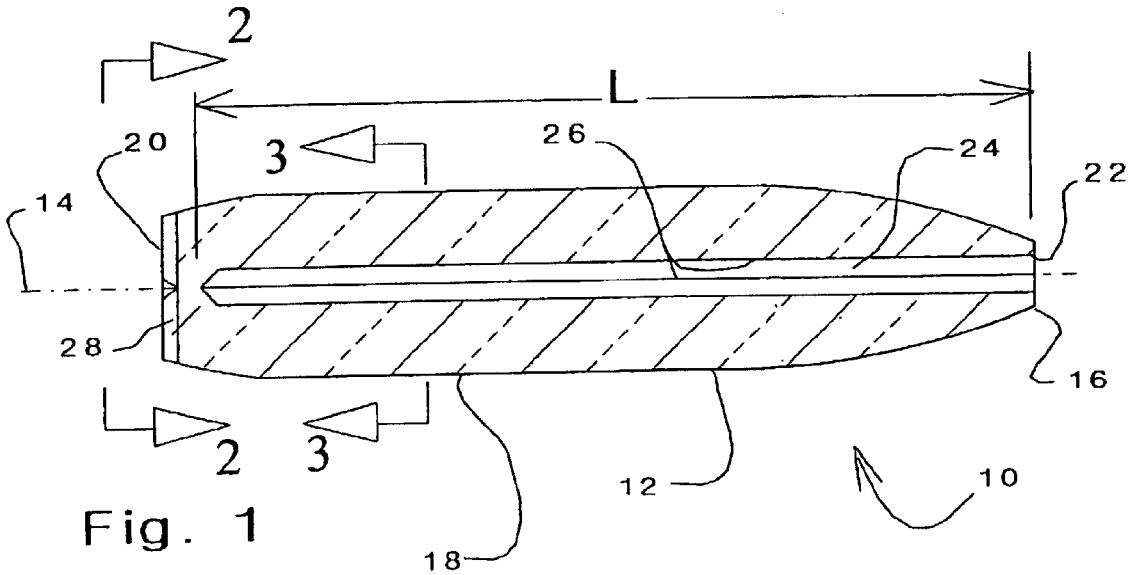
Fig. 1
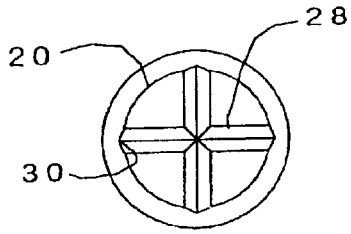
Fig. 2
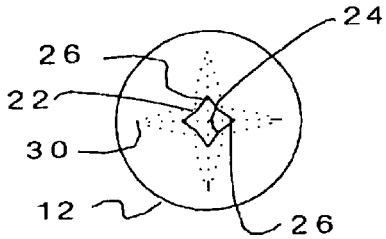
Fig. 3
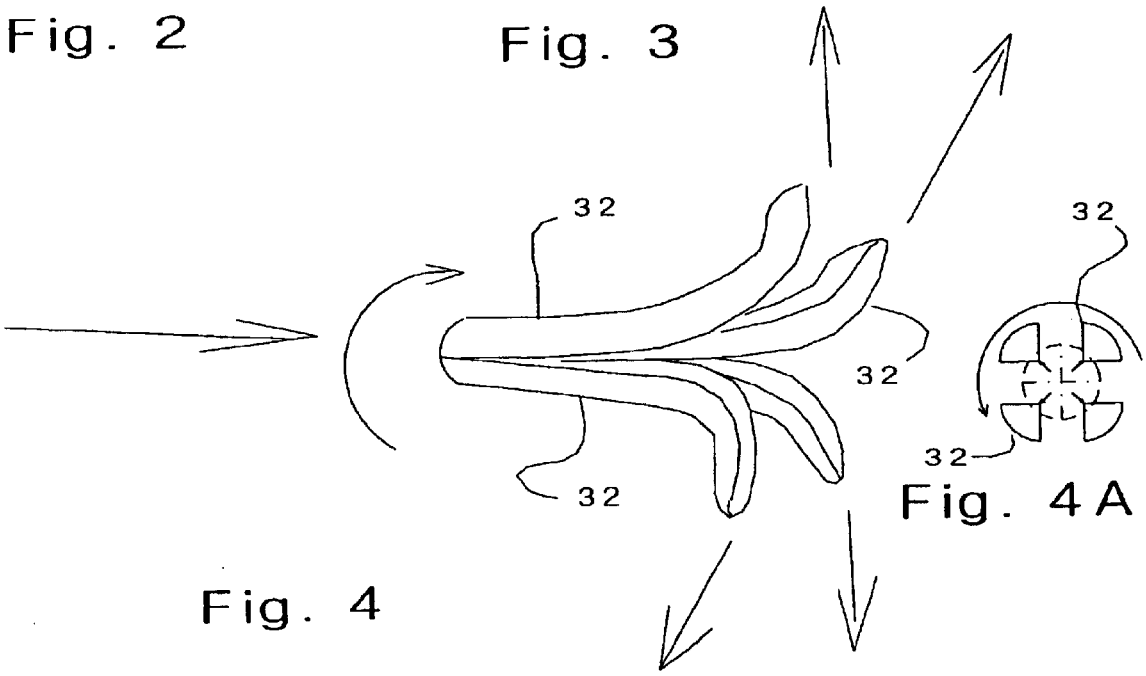
Fig. 4
Fig. 4A

FRAGMENTING BULLET

BACKGROUND OF THE INVENTION (a) Field of the Invention

This invention generally relates to a bullet that includes weakened grooves that allow the bullet to separate along pre-determined locations upon impact with a target, such as an animal. More particularly, but not by way of limitation, this invention relates to a controlled fragmenting bullet that uses the centrifugal force imposed by firing the bullet through a rifled barrel to enhance the distribution of the bullet fragments through the animal's body.

(b) Discussion of Known Art

The effectiveness of a particular bullet depends on the type of target and the distance from the gun at which the target is likely to be found. However, in order to maximize the killing ability of a particular bullet, it is well recognized that the use of controlled fragmentation projectiles results in greater damage to an animal as compared to bullets of equal mass and fired with the same velocity (all other factors being equal). The increased killing ability is largely due to the creation of multiple wound paths associated with each of the bullet fragments.

In order to take advantage of the effectiveness of fragmenting bullets, many bullet designers have come up with various configurations that are designed to break apart once the bullet strikes the animal. It is important to note that many fragmenting bullet designs have proven to be ineffective due to uncontrolled fragmentation, meaning complete disintegration of the bullet components upon striking the target. When fired through rifled barrels, the uncontrolled fragmentation is largely caused by the fact that the spinning of the bullet induced by the rifling imposes tremendous centripetal forces on the bullet. The components or materials used to hold the bullet together during travel are often not capable of adequately resisting these forces upon impact, and thus result in the uncontrolled complete disintegration of the bullet and very limited penetration. The forces induced by rifling are significant, since a bullet fired at 3,000 feet per second can achieve a rotational velocity of approximately 3,000 revolutions per second with common degrees of rifling. The centripetal force required to keep the fragments from separating can be calculated from the formula: $F=mr\omega^2$, where m is the mass of the fragment, r is the radius or distance from the central axis of the bullet to the center of gravity of the fragment, and $\omega$ is the speed of rotation (in radians per unit of time). It is important to note that the term "centrifugal force" is used herein to refer to the centripetal acceleration on a mass of material.

Accordingly, it will be understood that more aggressive rifling will have a more dramatic effect on the centripetal force than the caliber or size of the bullet, or the mass of the bullet or fragment. However, the important aspect to keep in mind from the above discussion is that the rotation due to rifling transfers a tremendous amount of energy into the bullet, and that this energy is stored in the bullet due to the rotation of the bullet. Furthermore, it is important to note that this rotational energy is not lost as quickly as the energy or momentum associated with the linear velocity of the bullet. The energy associated with linear velocity is lost rather quickly due to the aerodynamic forces (drag and turbulence effects) that are encountered by the bullet as it travels though the air. The rotational energy of the bullet, however, is largely preserved throughout the trajectory. The preservation of the rotational velocity and energy is largely due to the fact that the skin friction drag encountered in the direction of rotation, while the bullet rotates, is very small as compared to the aerodynamic forces encountered by the front of the bullet as it moves through air.

A review of known devices reveals that there are few bullets that take advantage of centripetal forces and the availability of energy stored in the bullet's rotation.

SUMMARY

It has been discovered that the problems left unanswered by known art can be solved by providing a bullet that includes:

(1) a generally cylindrical body having a nose, a mid-portion and a heel, the body having an aperture that starts at the nose, extends past the mid-portion of the bullet and ends near the heel of the bullet; the aperture also includes at least two scored areas along the sides of the aperture and extending along at least some or all of the aperture; and (2) a scored area along the heel portion of the bullet, the scored area along the heel terminating at a location that aligns with the scored area along the sides of the aperture in the bullet.

It is contemplated that the aperture in the bullet may be round with at least two or more scored grooves that extend along part of the entire length of the aperture. However, it is contemplated that the aperture, which is usually round, may be rectangular, square, triangular, slit shaped, parallelogram, diamond shaped, polygonal or other shape that causes deliberate stress points or breaking areas in the aperture, in order to induce controlled fragmentation of the bullet upon impact.

The scored grooves on the heel or rear end of the bullet will line up with the scored grooves along the inside of the aperture in the bullet. It has been discovered that by aligning scored grooves along the heel of the bullet with the corresponding scored areas or grooves along the sides of the aperture in the bullet, a controlled, deliberately fragmenting bullet that takes advantage of the momentum due to the rotation from rifling can be achieved. In operation, the bullet achieves a high rate of rotation from the rifling in the barrel of the gun. Then, as the bullet strikes a target, it begins to split along the scored grooves, or deliberate stress points, on the sides of the aperture. The bullet's rotation will then cause the individual fragments to move away from the bullet's line of travel. The scoring along the length of the bullet's aperture will force the separation to continue at the grooves or weakened areas on the heel of the bullet. The result is the controlled and deliberate separation of multiple fragments, with none of the fragments moving along the original line of travel of the bullet. This will result in multiple wound paths, each caused by a fragment that takes advantage of both the rotational momentum and the linear momentum of the bullet.

While the above and other advantages and results of the present invention will become apparent to those skilled in the art from the following detailed description and accompanying drawings, showing the contemplated novel construction, combinations and elements as herein described, and more particularly defined by the appended claims, it should be clearly understood that any changes in the precise embodiments of the herein disclosed invention are included within the scope of the claims, except insofar as they may be precluded by the prior art.

DRAWINGS

The accompanying drawings illustrate preferred embodiments of the present invention according to the best mode presently devised for making and using the instant invention, and in which:

FIG. 1 is a sectional view of an embodiment of the invention.

FIG. 2 illustrates the heel of the bullet incorporating the disclosed invention. The view being taken in the direction indicated by the arrows on FIG. 1.

FIG. 3 is a view taken at the location and in the direction indicated by the arrows on FIG. 1. The view illustrates an example of the aperture and the scored areas or grooves. Cross-hatching has been omitted for clarity.

FIG. 4 illustrates the separation achieved with the disclosed invention upon entry into the target.

FIG. 4A is an end view looking at the heel of the bullet and illustrates the separation achieved with the disclosed invention upon entry into the target.

Figure 5:
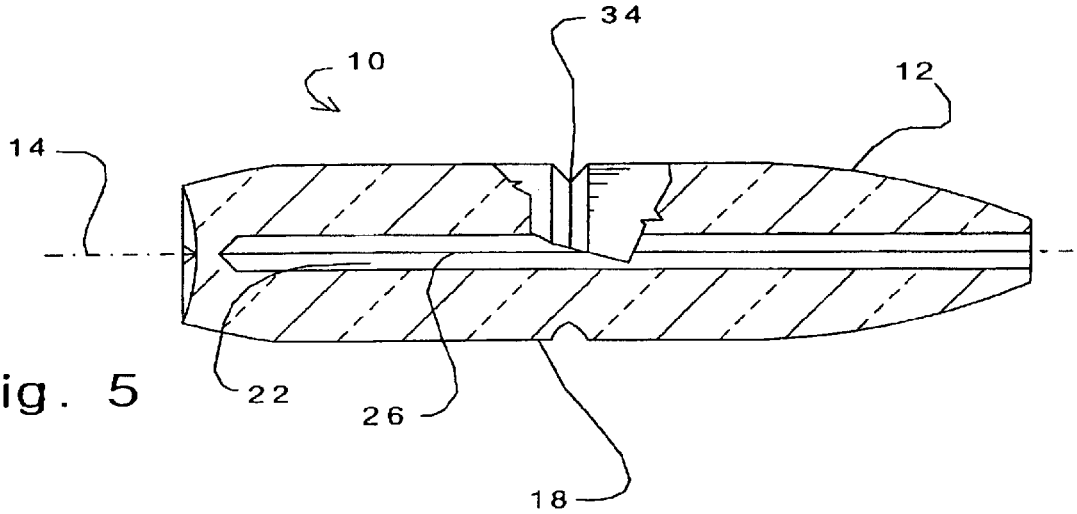

FIG. 5 illustrates another example of the disclosed invention.

Figure 6:
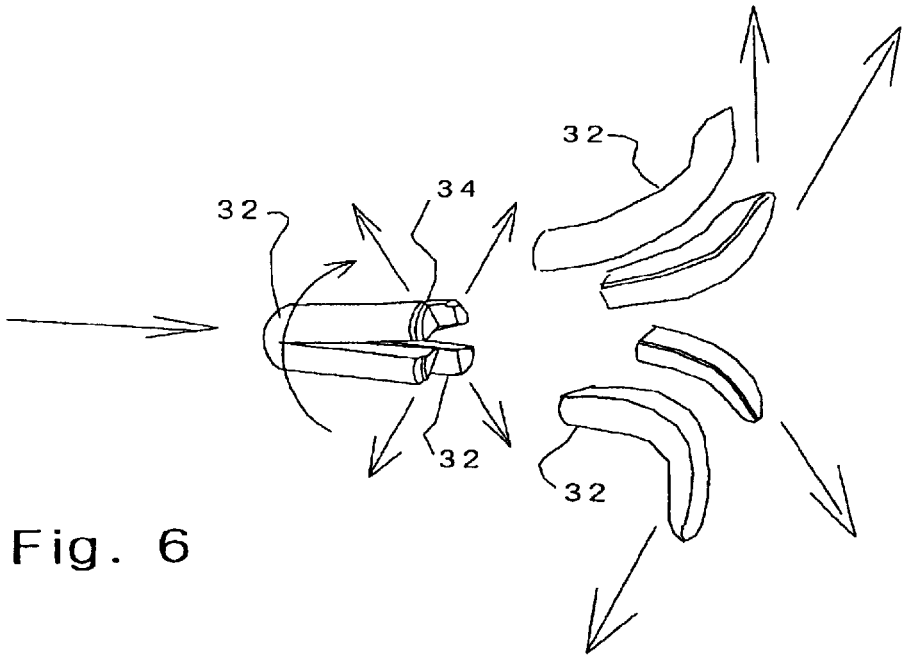

FIG. 6 illustrates the separation of fragments produced with the embodiment illustrated in FIG. 5.

Figure 7:
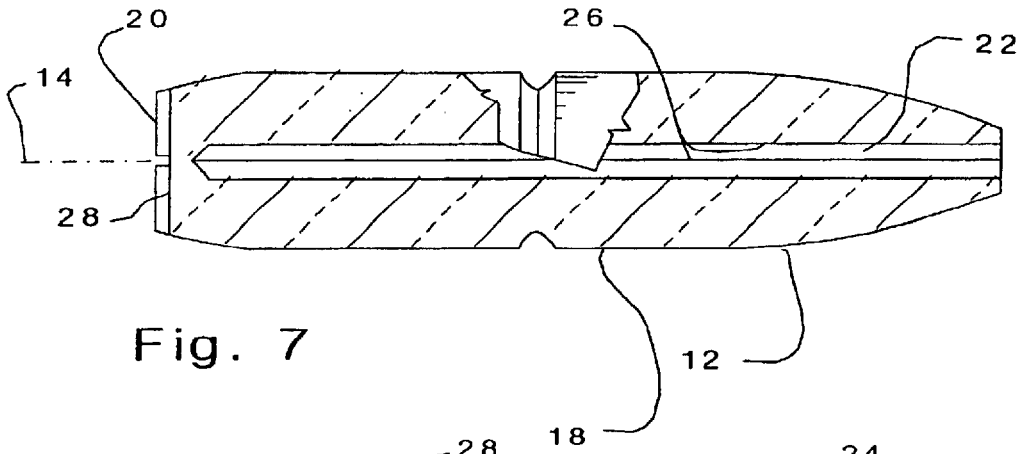

FIG. 7 illustrates another example of the disclosed invention. The example illustrates another configuration of the grooved or scored areas on the heel of the bullet.

Figure 8:
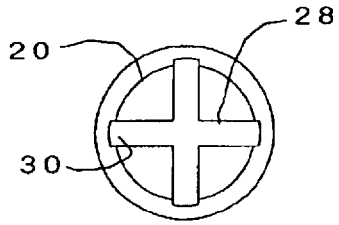

FIG. 8 is an end view, looking into the heel of the example shown in FIG. 7.

Figure 9:
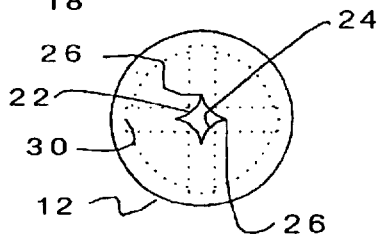

FIG. 9 is an end view, looking into the nose of the example shown in FIG. 7.

Figure 10:
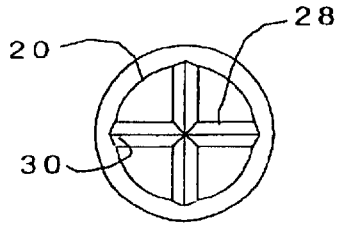

FIG. 10 is an end view, looking into the heel of another example of a configuration of the scored areas or grooves in the heel of a bullet.

Figure 11:
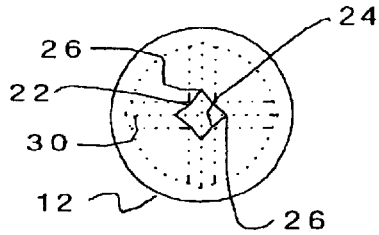

FIG. 11 is an end view, looking into the nose of the example shown in FIG. 10.

Figure 12:
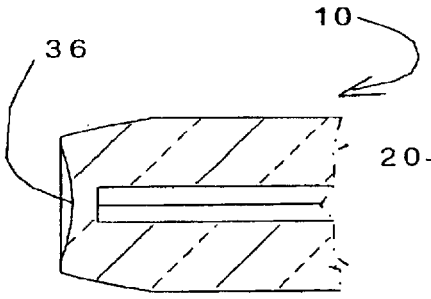

FIG. 12 is another example of the invention, the example illustrating the weakening of the heel area by incorporating a recessed area or dimple that allows cracks, from the aperture's scored areas or grooves to continue through the heel, making separate pieces.

Figure 13:
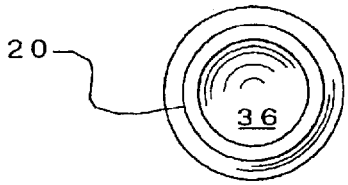

FIG. 13 is an end view looking at the heel shown in FIG. 12.

Figure 14:
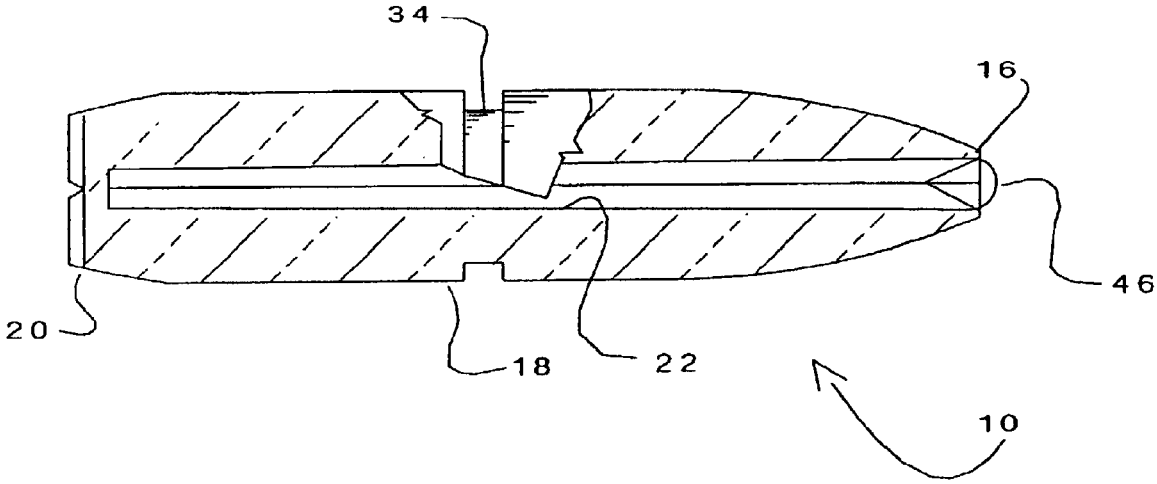

FIG. 14 illustrates the use of a tapered bore or aperture and scored areas or grooves to facilitate the incorporation of the scored grooves into the body of the bullet.

Figure 15:
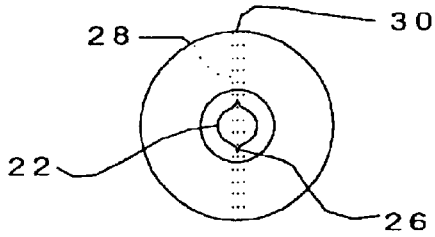

FIG. 15 illustrates an end view of an embodiment that included a single area or groove along the heel and the corresponding nose and scored areas or grooves in the aperture in the bullet.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Turning now to FIG. 1 where a bullet 10 including aspects of the disclosed invention has been illustrated. It is contemplated that the disclosed invention will be particularly useful in bullets that have a generally cylindrical body 12, which has been adapted for firing from a rifled gun-barrel. The body 12 will have a central axis 14, a nose 16, a mid-portion 18 and a heel 20.

As illustrated in FIGS. 1 and 3, the body 12 will also include an aperture 22 that starts at the nose 16, extends past the mid-portion 18 of the body 12, and ends near the heel 20. The depth of the aperture 22 should leave enough material between the bottom of the aperture 22 and the heel, such that the amount of material left near the heel of the bullet 10 will resist the pressures generated in the barrel during the firing of the gun. FIG. 3 shows that the aperture 22 includes sides 24 and that at least two axial scored areas or grooves 26 have been created along the sides 24 of the aperture 22. Furthermore, the axial scored areas or grooves 26 are generally parallel to the axis 14 and extend along at least some if not all of the length "L" of the aperture 22.

Turning to FIG. 2, it will be understood that the heel 20 will include at least one heel scored area 28 or goove. The heel scored area 28 or goove will extend across the heel 20 and terminating at a location 30 that is aligned with the axial scored areas or grooves 26 along the sides 24 of the aperture 22 in the body 12. The heel scored area 28 may be a generally "V" shaped groove that is shallower at the locations 30 where the groove or grooves terminate or may be of a slotted, rectangular cross-section, as shown on FIG. 8, or be of a "V" shaped cross-section that extends across the heel 20 of the bullet 10, illustrated in FIG. 10. The sharp bottom created by the grooves that have a "V" shaped cross-section, shown on FIG. 2 and 10 create a sharp stress-concentration that facilitates separation into segments or fragments. It is important to note that these stress concentrations may be formed in other shapes, and not only the cross-sections illustrated in the enclosed drawings.

FIG. 3 is a sectional view taken from the location indicated on FIG. 1, and in the direction of the arrows shown on FIG. 1. The view illustrates the alignment of the scored areas or grooves or heel scored grooves 26 and the axial scored areas or grooves 26 along the aperture 22.

Turning to FIG. 4, where the bullet 10 has been illustrated after impact on a target that causes the bullet 10 to fragment, it will be understood that the bullet 10 splits into fragments at the scored areas or grooves 20, including the axial scored areas or grooves 26 and the heel scored areas or grooves 20. Upon impact, the bullet will begin to expand and break away from the central axis 14. The centripetal forces that are required to keep the bullet together will be focused on the axial scored areas or grooves 26, since these represent significant stress-concentrations in the aperture 22 of the bullet 10. It is important to note that it is contemplated that the bullet 10 should be made from copper or a material that has mechanical properties that are similar to those of copper. It is contemplated that the disclosed invention may be fabricated from lead or a lead alloy, but it is contemplated that the disclosed grooves, weakened areas, or stress concentrations, would be particularly useful when the bullet is made of a material that is stiffer than lead, such as copper. It is known that highly malleable materials, such as lead, can yield easily, and thus relieve much of the effects of the stress concentration created by the grooves.

To maintain the maximum effectiveness of the bullet the disclosed invention separates completely and makes efficient use of the energy used to achieve the rotation of the bullet 10. Thus, as illustrated on FIGS. 4 and 4A, on impact, the bullet begins to separate to four distinct fragments 32, with the fragmentation extending the entire length of the bullet 10. Once the separate fragments 32 have formed within the target, each will proceed further but outward from the center that is motivated by the centrifugal momentum and the linear momentum associated with the inertia of the fragments.

Turning now to FIG. 5, it will be understood that it is contemplated that the generally cylindrical body 12 of the bullet 10 may include one or more external groove 34 that extends around the entire cylindrical body 12 at a location on the mid-portion 18 of the body 12. This grooved area will serve as a weak spot to break and produce further fragmentation of the bullet upon impact. Thus, as shown in FIG. 6, the illustrated example would produce eight sections rather than four as provided by the example shown in FIG. 1.

Turning to FIG. 7, it will be understood that the layered fragmentation bullet illustrated in FIG. 5 should include heel scored areas or grooves 28 that coincide with the axial scored areas or grooves 26, and thus produce complete controlled fragmentation of the bullet upon impact. It is important to note that the complete controlled fragmentation of the embodiment illustrated in FIG. 5 or 7 will result in eight distinct wound paths created by the fragments radiating outward from the axis of travel of the bullet. The number of fragments created depends on the number of scored areas or grooves formed along the aperture 22, the body 18, and the heel 20. Thus, as illustrated in FIG. 15, a single, linear, heel scored area or groove across the heel of the bullet, and a pair of axial scored areas or grooves along the aperture 22 in the body of the bullet 10 will result in two fragments that both divert from the bullet's original trajectory, without necessarily leaving fragments moving along the bullet's original trajectory. In other words, nothing stays in the center, along the original trajectory, and all or nearly all of the centrifugal force energy is absorbed within the target.

It is important to note that the fragmentation produced by having scored areas or grooves or deliberate stress points along the sides 24 of the aperture 22 and along the heel 20 of the bullet 10, it is also contemplated that the heel may be weakened by dishing out or thinning the heel 20 as shown in FIGS. 12 and 13. The heel scored areas or grooves 28 illustrated in FIGS. 2, 3, and 8–11 will produce separation at the heel in pie-slice shapes having a generally v-shaped cross-section. The dished heel 36 is not likely to produce this sharply defined segmentation, but it is contemplated that this thinning will allow the fragments to completely separate, without leaving a portion of the bullet traveling along the original trajectory. FIG. 15 illustrates an end view of an embodiment that included a single groove or scored area along the heel and the corresponding nose and scored areas or grooves in the aperture in the bullet.

Still further, it is contemplated that an external groove 34 may be incorporated along the external surface of the mid-portion 18 of the bullet. Additionally, as shown on FIG. 14, a ramming nose 46 may be inserted into the aperture 22 to commence separation of the fragments as the bullet strikes the target.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A bullet comprising:

a generally cylindrical body, the body having a central axis, a nose, a mid-portion and a heel, the body further having an aperture that starts at the nose, extends past the mid-portion of the body and ends near the heel of the body, the aperture including sides and at least two axial scored areas along the sides of the aperture, the axial scored areas or grooves being generally parallel to said axis and extending along at least most of the aperture; and at least one external, elongated heel groove across the entire heel portion of the body and extending into the body from the heel towards the nose of the bullet, the heel groove terminating at a location that is axially aligned with the axial scored areas along the sides of the aperture in the body.

2. A bullet according to claim 1 wherein said bullet comprises four axial scored areas, and a pair of external, elongated heel grooves, the external, elongated heel grooves and the axial scored separating the body in four approximately equal fragments about the central axis.

3. A bullet according to claim 1 that is made of unitary, one-piece construction.

4. A bullet according to claim 2 that is made of unitary, one-piece construction.

5. A bullet according to claim 1, having a ramming nose, the ramming nose being adapted for partially fitting into the aperture, so that on impact the ramming nose is driven into the aperture, causing the bullet to fragment along the axial scored areas or grooves.

6. A bullet comprising:

a generally cylindrical body, the body having a central axis, a nose, a mid-portion and a heel, the body further having an aperture that starts at the nose, extends past the mid-portion of the body and ends near the heel of the body, the aperture including sides and at least two axial scored grooves along the sides of the aperture, the axial scored grooves being generally parallel to said axis and extending along at least most of the aperture;

said generally cylindrical body further comprising at least one external groove extending around the entire cylindrical body at a location on the mid-portion of the body; and a heel scored area that is externally positioned along the heel portion of the body and extends along the entire heel portion of the body and up along a portion of the sides of the body of the bullet, the heel scored area terminating at a location that is axially aligned with the axial scored areas along the sides of the aperture in the body.

7. A bullet according to claim 6 wherein said bullet body is made of copper.

8. A bullet according to claim 6 comprising four axial scored grooves, and a pair of heel scored grooves, the heel scored grooves and the axial scored grooves separating the body in four approximately equal fragments about the central axis.

9. A bullet according to claim 6 wherein said bullet body is made of copper.

10. A bullet according to claim 6 that is made of unitary, one-piece construction.

11. A bullet according to claim 8 that is made of unitary, one-piece construction.

* * * * *